US007156064B2

(12) United States Patent
Namari et al.

(10) Patent No.: US 7,156,064 B2
(45) Date of Patent: Jan. 2, 2007

(54) ENGINE STARTING CONTROL APPARATUS AND STARTING CONTROL METHOD

(75) Inventors: Takashi Namari, Shioya-gun (JP); Harumi Hiramine, Kawasaki (JP); Masato Ono, Shioya-gun (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/817,957

(22) Filed: Apr. 6, 2004

(65) Prior Publication Data

US 2005/0103301 A1 May 19, 2005

(30) Foreign Application Priority Data

Apr. 8, 2003 (JP) ..... 2003-104111

(51) Int. Cl.
*F02N 11/08* (2006.01)

(52) U.S. Cl. ..... 123/179.3

(58) Field of Classification Search ..... 123/179.3, 123/179.21, 179.22, 179.23
See application file for complete search history.

(56) References Cited

U.S. PATENT DOCUMENTS 5,349,931 A * 9/1994 Gottlieb et al. ..... 123/179.2
5,798,577 A * 8/1998 Lesesky et al. ..... 123/179.3
5,816,221 A * 10/1998 Krueger ..... 123/491
5,886,418 A * 3/1999 Kondo et al. ..... 307/9.1
5,936,316 A * 8/1999 Jurkiewicz et al. ..... 123/179.3
5,937,829 A * 8/1999 Endou ..... 123/497
6,557,509 B1 * 5/2003 Hall et al. ..... 123/179.16

FOREIGN PATENT DOCUMENTS

EP 0646723 A1 * 4/1995
JP 08277767 A1 * 10/1996
JP 10-184506 7/1998
JP 11-37023 2/1999
JP 200054878 A1 * 2/2000
JP 2001-082299 3/2001
JP 2002-098032 4/2002

* cited by examiner

*Primary Examiner*—Stephen K. Cronin
*Assistant Examiner*—Arnold Castro
(74) *Attorney, Agent, or Firm*—Arent Fox PLLC

(57) ABSTRACT

An engine start control apparatus has a power generating circuit that generates power by a starting operation of a starter apparatus that starts an engine, an engine starting circuit that is connected to the power generating circuit and to which various devices required to start the engine are connected, and an accessory circuit that is connected to the engine starting circuit and is provided with various devices that are not required to start the engine. In a state in which a supply of power to the accessory circuit is stopped, power is supplied from the power generating circuit side to the engine starting circuit side.

3 Claims, 1 Drawing Sheet

ENGINE STARTING CONTROL APPARATUS AND STARTING CONTROL METHOD

BACKGROUND OF THE INVENTION

1. Field of the Invention

The present invention relates to a control apparatus for starting an engine and to a control method for starting an engine.

Priority is claimed on Japanese Patent Application No. 2003-104111, filed Apr. 8, 2003, the contents of which are incorporated herein by reference.

2. Description of Related Art

When starting an engine such as, for example, an outboard motor, an ignition device is operated using power from a battery so as to start the engine. When the engine has started, power is generated by an AC generator and this generated power is stored in a battery. A recoil starter apparatus is additionally provided in the engine, and when the battery is at low capacity, it is possible to start the engine manually using this recoil starter apparatus.

As electrical equipment circuits for an engine such as the aforementioned outboard motor, an electrical equipment circuit has been disclosed (see, for example, Japanese Unexamined Patent Application, First Publication No. Hei 11-37023) that is provided with a charging circuit in which a rectifier and a voltage regulator are connected to the AC generator that is connected to the battery, a power circuit for electrical equipment of an engine that is connected to the charging circuit and that includes an ignition circuit, and an accessory circuit that is connected to a circuit for accessories on the boat body side.

However, in the aforementioned conventional engine electrical equipment circuit, because power is supplied to both the engine electrical equipment power circuit and the accessory circuit when the engine is started, when the engine is cold or when the battery is at low capacity such as when the remaining capacity is low, if sufficient power is not supplied to the ignition circuit, a problem arises in that the engine startability is reduced.

In particular, if the engine in question is an outboard motor that is additionally provided with a recoil starter apparatus, because it is necessary to start the engine using the generated power of the AC generator inside the limited time that the wire of the recoil starter apparatus is being pulled for, it is necessary to enlarge the capacity of the AC generator, and the problem arises that the load of the recoil starter manual starting operation is increased so that the marketability of the recoil starter is reduced.

Moreover, in a type of engine that is provided with a fuel injection apparatus, due to the relationship in which fuel is supplied to an injector by a fuel pump and fuel injection is performed by the driving of the injector, a great deal of power is required by the engine startup. As a result, the above described problem is a substantial obstacle.

In view of these circumstances, it is an object of the present invention to provide an engine starting control apparatus and starting control method that improves startability and enables an engine to be started reliably.

SUMMARY OF THE INVENTION

In order to solve the above described problems, an engine start control apparatus of the present invention has a power generating circuit that generates power by a starting operation of a starter apparatus that starts an engine, an engine starting circuit that is connected to the power generating circuit and to which various devices required to start the engine are connected, and an accessory circuit that is connected to the engine starting circuit and is provided with various devices that are not required to start the engine, and wherein in a state in which a supply of power to the accessory circuit is stopped, power is supplied from the power generating circuit side to the engine starting circuit side.

By employing this configuration, the limited generated power that is obtained by the power generating circuit during the cranking that is performed directly after the starting operation using the starter apparatus, can be prevented from being supplied to the accessory circuit, and generated power can be supplied to and concentrated in the engine starting circuit.

Accordingly, it is possible to start an engine using an AC generator that produces the minimum amount of generated power that is required. Accordingly, an effect is obtained in that it is possible to achieve a reduction in both size and weight of the AC generator. As a result, the load on the operator when starting an engine using the starter apparatus is reduced, and an effect is obtained in that marketability is improved.

A switch that shuts down a supply of power to the accessory circuit may be provided in the accessory circuit, and the supply of power to the accessory circuit may be stopped by the switch prior to a starting operation performed by the starter apparatus.

In this case, the limited generated power that is obtained by the power generating circuit during the cranking that is performed directly after the starting operation using the starter apparatus can be prevented from being supplied to the accessory circuit by the power supply shutdown operation by the switch device, and the generated power can be supplied to and concentrated in the engine starting circuit.

Accordingly, it is possible to start an engine reliably using an AC generator that produces the minimum amount of generated power that is required.

In an engine start control method of the present invention, in which, in a state in which a supply of power to the various devices that are not required to start the engine is stopped, during a time from a starting operation that uses the starter apparatus that starts the engine until the engine is started, the supply of power from the starter apparatus is supplied to the various devices that are required to start the engine.

According to this method, the limited generated power that is obtained by the power generating circuit during the cranking that is performed directly after the starting operation using the starter apparatus is prevented from being supplied to the various devices that are not required to start the engine.

Accordingly, the generated power can be used for starting without any being wasted, and an engine can be started quickly.

DETAILED DESCRIPTION OF THE INVENTION

Figure 1:
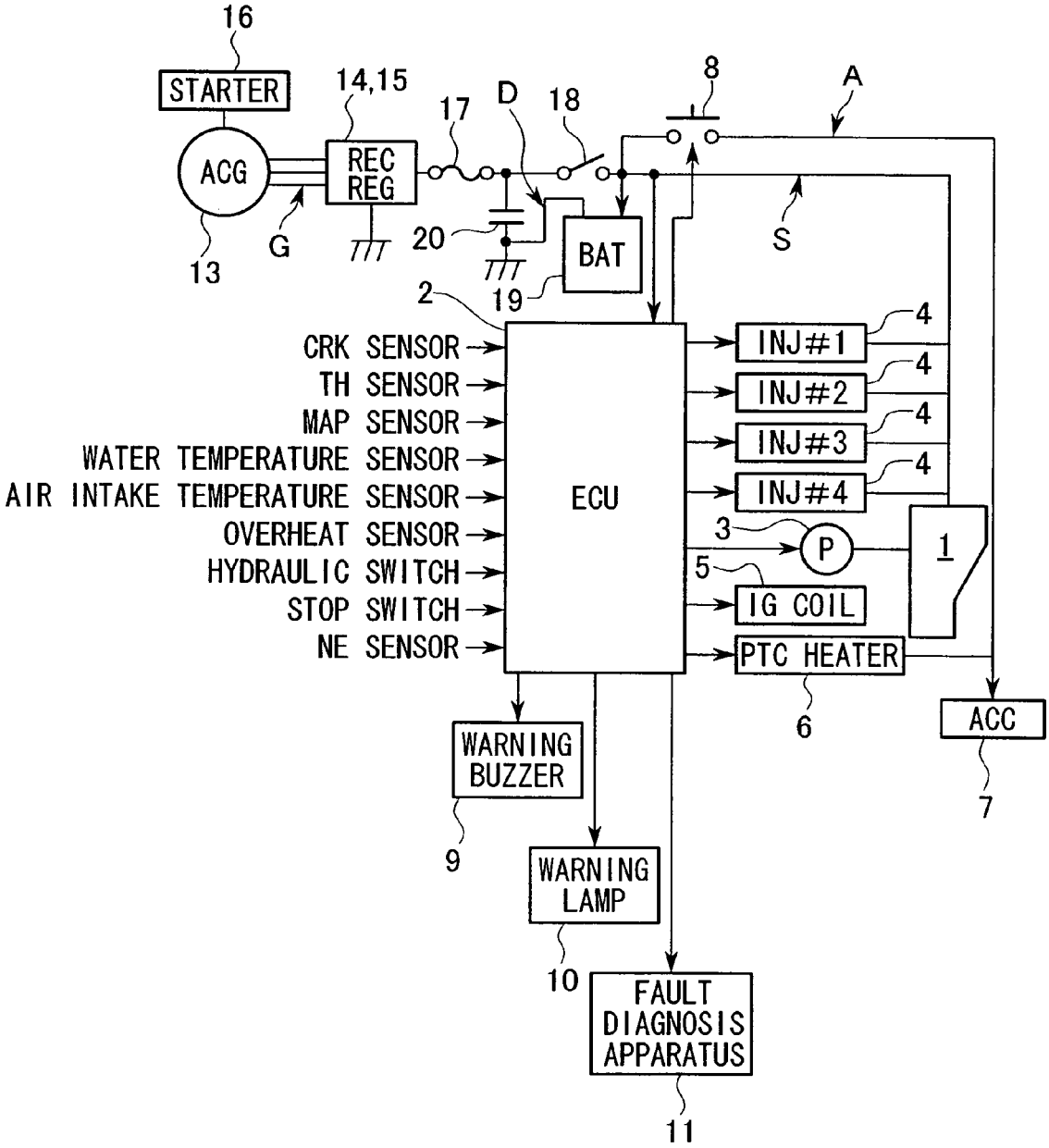
FIG. 1 shows a system configuration of an outboard motor that uses an embodiment of the engine starting control apparatus and starting control method of the present invention.

One embodiment of an engine starting control apparatus and starting control method of the present invention will be described below referring to the figures.

FIG. 1 shows a system configuration of an outboard motor according to the embodiment of the present invention. An engine (not shown) of the outboard motor 1 is provided with a fuel pump (P) 3 that is driven via an ECU 2. Fuel that is supplied by this fuel pump 3 is injected by injectors (INJ#1 to INJ#4) 4, and is ignited by the charging of an ignition (IG) coil 5 with electricity so that it burns inside cylinders.

The ECU 2 performs control of the quantity of fuel supplied by the injectors 4, of injection timing, and of ignition timing by the ignition coil 5. The ECU 2 also performs control of a PTC heater 6 for idling control, and performs control of the opening and closing of a relay (i.e., of a switch device) 8 (described below) that is provided in an accessory circuit A for accessories (ACC) 7 such as lamps and the like. The ECU 2 is formed by a CPU, which is a central processing unit that performs various types of calculation processing, RAM, which stores data currently being calculated by the CPU, ROM, which stores tables, maps, and programs executed by the CPU, and EEP•ROM, which stores backup data and the like.

Consequently, signals from a crank angle (CRK) sensor, a throttle aperture (TH) sensor, an MAP sensor that measures intake negative pressure of the engine, a water temperature sensor that measures the engine cooling water temperature, an air intake temperature sensor, an overheating sensor, a hydraulic switch for engine cooling oil, a stop switch for rapid shutdown, and an engine revolution number (NE) sensor, are input into the ECU 2. Warnings by a warning buzzer 9 and a warning lamp 10, and data exchange with a fault diagnosis apparatus 11 is performed, if necessary.

The symbol 13 denotes an AC generator (ACG). The AC generator 13 generates power when the engine is being driven, and is connected to a rectifier (REC) 14 and a regulator (REG) 15 that regulates voltage so as to form a power generating circuit G.

A recoil starter apparatus 16 is connected to the AC generator 13 of the power generating circuit G. The recoil starter apparatus 16 is a starter apparatus that starts the engine when a starter rope is pulled.

An engine starting circuit S, to which are connected a variety of instruments that are required for starting the engine, is connected to the power generating circuit G via a fuse 17 and a main switch 18. The variety of instruments that are required when starting the engine include a fuel pump 3 that supplies fuel to the engine via an injector 4, an ignition coil 5 that performs ignitions, and the ECU 2 that controls all of these. Accordingly, because the AC generator 13 is also able to generate power in a starting operation that uses the manual recoil starter apparatus 16, it is possible to produce starting power for the ECU 2, drive power for the fuel pump (P) 3, and the like even when the battery is at low capacity. Note that if there is sufficient residual capacity in a battery 19, the ECU 2 is able to start by receiving a supply of power from a power supply circuit 9.

The accessory circuit A, which is provided with a variety of instruments that are not required when starting the engine, is connected to the engine starting circuit S. Here, the term "accessory" refers to headlamps, instrument lamps, solenoids for various devices, and the like.

A normal open type of relay 8, which is able to be opened and closed by the ECU 2 and which interrupts the supply of power to an accessory circuit 7 from the power generating circuit G, is provided in the accessory circuit A in the vicinity of the portion where it connects with the power generating circuit G. This relay 8 is turned ON when the engine is being started, and is turned OFF when the engine has started. As a result, in a state in which the supply of power to the accessory circuit A is stopped, it is possible to supply power from the power generating circuit G to the engine starting circuit S.

The battery (BAT) 19 that supplies power to the engine starting circuit S and the accessory circuit A regardless of whether or not the main switch 18 is open or closed, is connected to the engine starting circuit S and the accessory circuit A. The battery 19 is connected to a condenser 20 that is connected between the main switch 18 and the fuse 17. A power supply circuit D is formed by the battery 19 and the condenser 20.

Accordingly, the engine starting circuit S is able to perform normal engine starting using power of the battery 19 of the power supply circuit D. In addition, it is also possible to perform engine starting using the AC generator 13 by using the recoil starter apparatus 16.

The battery 19 of the power supply circuit D is charged via the rectifier 14 and the regulator 15 by the power generating circuit G.

Next, an operation of the engine control apparatus will be described.

When the AC generator 13 is driven by the recoil starter apparatus 16, power produced by the AC generator 13 is reduced to a predetermined voltage by the rectifier 14 and the regulator 15. The ECU 2 is then started by the main switch 18 which is in an ON state, and the voltage is supplied to the engine starting circuit S.

At this time, if cranking is performed using the recoil starter apparatus 16, because the relay 8 is turned OFF and the engine has not been started, the limited power that is obtained from the cranking is supplied only to the engine starting circuit S without being dissipated, and is used only for starting the engine.

When the engine starts and, for example, the number of engine revolutions NE reaches an idling number of revolutions and the engine startup is completed, the relay 8 is turned ON by the ECU 2, so that power is able to be supplied to the accessory circuit A for the accessories 7, and moreover, power is supplied to the PTC heater 6, and, if necessary, idling control is performed.

Once the engine has been started, the battery of the power supply circuit D is charged by the power produced by the AC generator 13 of the power generating circuit G.

Accordingly, according to the present embodiment, because the limited generated power that is obtained by the power generating circuit G during the cranking that is performed directly after the starting operation using the recoil starter apparatus 16 can be prevented from being supplied to the accessory circuit A, and generated power can be supplied to and concentrated in the engine starting circuit S, it is possible to start the engine using the AC generator 13 that produces the minimum amount of generated power that is necessary. Accordingly, the size and weight of the AC generator 13 can be reduced, thereby resulting in the load on the operator in a starting operation using the recoil starter apparatus 16 being reduced. Consequently, the marketability of this recoil starter apparatus 16 is improved.

Moreover, because the relay 8 that shuts down the supply of power to the accessory circuit A is provided in the accessory circuit A, and the supply of power to the accessory circuit A is stopped by the normal open type of relay 8 prior to the starting operation using the recoil starter apparatus 16, the limited generated power that is obtained by the power generating circuit G during the cranking that is performed directly after the starting operation using the recoil starter apparatus 16 can be prevented from being supplied to the accessory circuit A by the power supply shutdown operation to shut down the supply of power to the accessory circuit A by the relay 8, and the generated power can be supplied to and concentrated in the engine starting circuit S.

While a preferred embodiment of the invention has been described and illustrated above, it should be understood that this is exemplary of the invention and is not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

For example, in the above described embodiment, a description is given using an outboard motor 1 that is provided with the recoil starter apparatus 16 as an example; however, the present invention can also be applied to a starting apparatus of a three-wheel or four-wheel buggy that is provided with a kick starter apparatus. Moreover, a description is given of a case in which the battery 8 is provided in combination with the recoil starter apparatus 6; however, the present invention may also be applied for the batteryless type engine.

What is claimed is:

1. An engine start control apparatus comprising:

a power generating circuit that generates power by a starting operation of a starter apparatus that starts an engine;

an engine starting circuit that is connected to the power generating circuit and to which various devices required to start the engine are connected; and an accessory circuit that is connected to the engine starting circuit and is provided with various devices that are not required to start the engine, wherein:

the accessory circuit includes a switch device which interrupts a supply of power from the power generating circuit to the accessory circuit;

said various devices required to start the engine includes an ECU which controls the switch device; and in a state in which a supply of power to the accessory circuit is stopped by the ECU, power is supplied from the power generating circuit side to the engine starting circuit side.

2. The engine start control apparatus according to claim 1, wherein:

the switch device is a normal open type of relay which is controlled so as to be opened and be closed by the ECU; and the switch device stops a supply of power from the power generating circuit to the accessory circuit prior to the starting operation of the starter apparatus, while the switch device is controlled by the ECU so as to permit a supply of power from the power generating circuit to the accessory circuit after starting the engine.

3. An engine start control method in which, in a state in which a supply of power to the various devices that are not required to start an engine is stopped by a relay which is controlled so as to be opened and be closed by an ECU, during a time from a starting operation that uses a starter apparatus that starts the engine until the engine is started, the supply of power from the starter apparatus is supplied to the various devices that are required to start the engine.

* * * * *